United States Patent [19]

Woods

[11] 4,048,919

[45] Sept. 20, 1977

[54] WATER FOUNTAIN CONTROL WIPER UNIT FOR OFFSET PRINTING MACHINES

[76] Inventor: Kenneth D. Woods, P.O. Box 141 Star Rte., Spring Valley, Calif. 92077

[21] Appl. No.: 601,362

[22] Filed: Aug. 4, 1975

[51] Int. Cl.[2] ..... B41F 7/26; B41F 9/10

[52] U.S. Cl. ..... 101/148; 101/157; 101/169; 101/350; 15/256.51; 118/261

[58] Field of Search ..... 101/147, 148, 349, 350, 101/156, 157, 169; 15/256.51; 24/255 R, 255 SC; 248/204, 226 E, 216 D; 118/203, 204, 261

[56] References Cited

U.S. PATENT DOCUMENTS

| | | | |
|---|---|---|---|
| 1,546,116 | 7/1925 | Bradt | 248/226 E |
| 1,580,829 | 4/1926 | Lengel | 101/350 |
| 1,883,572 | 10/1932 | Clark | 101/350 |
| 2,891,471 | 6/1959 | Sengewald | 101/169 |
| 3,198,697 | 8/1965 | Justus | 15/256.51 |
| 3,312,166 | 4/1967 | Gentile | 101/169 |
| 3,599,916 | 8/1971 | Szabo | 248/226 E |
| 3,626,833 | 12/1971 | Koch | 15/256.51 |
| 3,704,662 | 12/1972 | Johnson et al. | 118/261 |
| 3,807,675 | 4/1974 | Seckerson et al. | 248/226 E |
| 3,880,077 | 4/1975 | Glaser | 101/350 |
| 3,911,816 | 10/1975 | Hutton | 101/148 |

*Primary Examiner*—Edgar S. Burr
*Assistant Examiner*—William Pieprz
*Attorney, Agent, or Firm*—Brown & Martin

[57] ABSTRACT

A water fountain control wiper unit of resilient material having a tubular portion on one edge that is slit for fitting over the edge of the fountain tray. The wiper has sufficient width so that a relatively flat surface tangentially adjacent the water fountain roller is biased against the water fountain roller to remove water upon rotation of the water fountain roller. The wiper unit has a length substantially shorter than the length of the water fountain roller so that one or more of the wiper units can be positioned along the length of the fountain roller to provide selective water removal, and the connector on the wiper blade unit allows the wiper blade to be quickly and easily mounted on or removed from the connected position on the edge of the water fountain tray.

7 Claims, 4 Drawing Figures

WATER FOUNTAIN CONTROL WIPER UNIT FOR OFFSET PRINTING MACHINES

BACKGROUND OF THE INVENTION

Multilith models and other makes of offset printing machines, two color printing heads, etc., have water fountain trays with a water fountain roller positioned therein. The water or water fountain solution is transferred from the water fountain roller to a plate cylinder that carries the printing plate that in turn contacts a blanket cylinder that transfers the image to the paper passing therethrough. When operating such printing machines and the like, it sometimes occurs that a disproportionate amount of water builds up on sections of the water fountain roller. This can occur where, for example, narrow paper stock, envelopes or the like are run through the printing machine. When running narrow stocks, the area adjacent to the paper stock will often accumulate an excessive amount of water or fountain solution in a very short length of running time, because there is no water absorption by the paper stock taking place in this area. This results in an immediate imbalance of ink and fountain solution and excessive moisture build up in this area. While the plate must be wet enough to prevent blacking-up (dry plates), the water should not be so excessive as to create a water imbalance with the ink, or of a sufficient excess magnitude as to feed back into the ink unit itself. Thus, it is desirable to control the amount of water on the fountain roller.

Also where a portion of the roller may be running dry, the amount of water can be increased on the roller thus providing additional water or fountain fluid to the dry portion of the roller. The resultant excess fluid on the other areas of the water fountain roller is then controlled by the wiper unit.

There have been attempts in the past to use devices to contol the amount of water on the water fountain roller. These devices generally comprise a pivot bar mounted above the water fountain roller with wipers connected thereto. These wipers have end tips that ride on the surface of the fountain roller, or in reality on a film of water, without wiping any water off the fountain roller. The pivot bars that support the wipers are expensive to install, are a mechanical problem, are fixed in position, and do not provide an adequate control of excess fountain fluid on the roller.

So it is desirable to have a new and improved water fountain control wiper unit that provides complete control of the water on the fountan roller and relieves the operator of the various and troublesome water problems encountered in such units, and that may be selectively adjusted by the operator to compensate for different water distributions at selected areas across the surface of the water fountain roller, permitting easier operation of the machine and improved printing results.

SUMMARY OF THE INVENTION

In an embodiment of this invention, the water fountain control wiper unit comprises a wiper blade having a given length that is substantially shorter than the length of the water fountain roller, and that has a width sufficient to extend from the mounting edge of the water fountain tray to a point beyond the tangential surface of the water fountain roller. Connector means are connected to one side of the wiper blade for fitting on the edge of the fountain tray and holding the side surface of the wiper blade in a resiliently biased contact against the fountain roller. Thus upon rotation of the fountain roller, the wiper blade wipes fountain tray fluid from the roller.

The connector unit generally comprises a tubular portion of resilient material along the edge of the wiper blade that has a slit therethrough. The slit portion can be spread sufficiently to allow the side thereof to fit over the edge of the fountain tray. This resiliently holds the wiper blade in position and biases the side of the wiper blade against the tangential surface of the fountain roller.

Since the length of the wiper blade is substantially shorter than the length of the fountain roller, one or more of the wiper blades can be positioned in place and slidably positioned along the length of the tray edge to contact desired areas of the roller and remove fluid from selective areas of the fountain roller. In actual operation, the wiper blades can have selective differing lengths to provide different combinations of wiper blade mountings to achieve different fluid removing contact with the fountain roller.

The wiper blade units are made of integral resilient material that insures long life with the desired flexibility, and have sufficient strength and tension to properly engage the surface of the fountain roller. The speed of rotation of the roller can be selectively varied to vary the actual amount of water being removed by each wiper unit.

It is therefore an object of this invention to provide a new and improved fountain control wiper unit.

Other objects and many advantages of this invention will become more apparent upon a reading of the following detailed description and an examination of the drawing, where like reference numerals designate like parts throughout and in which.

Figure 1:
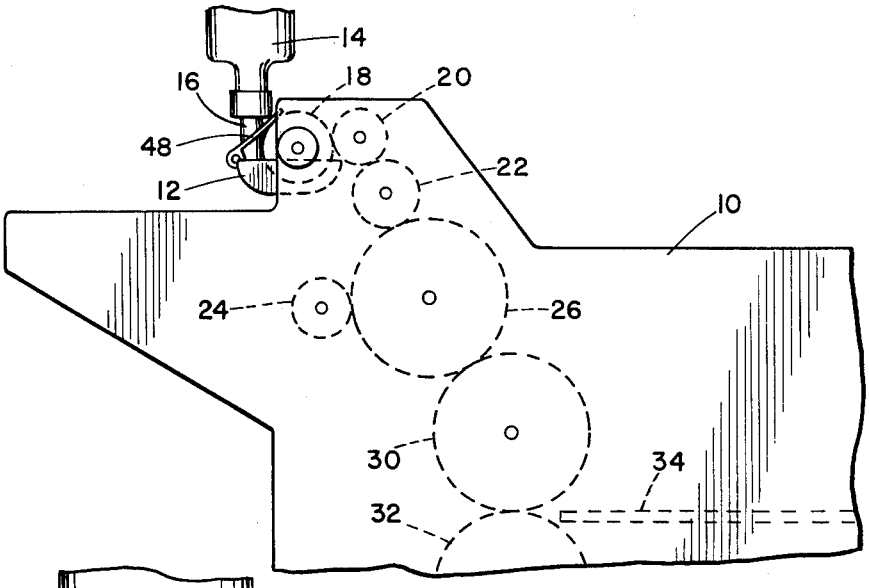
FIG. 1 is a side elevational view of a portion of a typical offset printing press, showing the pertinent roller arrangement and the installation of the fountain control wiper unit.

Referring now to the drawing, a typical offset printing press 10 has a water or fluid fountain section comprising a tray 12 for holding the fluid, a conduit 16 for feeding fluid from a water bottle or the like 14 into the tray 12, and a fountain roller 18 that is supported by bearing members 36 and 42 for rotation in the fluid in the fountain tray 12. In a typical installation, the water fountain roller 18 transfers water to water transfer rollers 20 and 22 that in turn transfers the water fluid to the plate cylinder 26 that also receives ink from the ink roller 24. The plate cylinder 26 carries the printing plate. Images are then transferred to the blanket cylinder 30 that transfers the image to the paper that is moving along the paper guide 34. The impression cylinder 32 provides a backing for the paper passing between the blanket cylinder 30 and the impression cylinder 32.

The fluid from the water fountain section aids in the image transfer as is known in the art. This fluid may be water or other suitable known fluids, and is designated herein by the term "water". It may be recognized that with the fountain roller 18 rotating in the fluid in the fountain tray 12, a uniform amount of fluid is applied to the roller. This in turn is passed through the various rollers and cylinders to the paper. Because of the different printing jobs that are accomplished by the printing press, unbalanced conditions can exist in the water transferred by the water fountain roller 18. This can occur particularly when running narrow paper stocks, such as envelopes and cards and the like, or in difficult inking situations where the proper balance of ink and fountain solution must be maintained for proper printing results.

A water fountain control wiper blade unit 48 has a flat blade portion 54 and a split sleeve or tubular portion 50. The tubular portion 50 is positioned to one side of the blade portion 54 and the slit 52 allows the split sleeve or tubular portion to be fitted over the edge 44 of the fountain tray 12. The slit 52 is positioned in the sleeve or tubular portion 50 so that when the wiper blade unit 48 is clipped onto the edge of the fountain tray 12, the blade portion 54 presses against and contacts tangentially the outer surface of the fountain roller 18. The wiper blade unit 48 is made of resilient material such as rubber, neopreme or the like. The connector means 50 resiliently biases the resilient blade portion 54 into contact with the outer surface of the fountain roller 18 with sufficient force to cause a capillary build up of the water 49 in back of the blade 54 that causes the water to drop back into the water supply 38 in tray 12, thus controlling the water on the surface of the fountain roller 18. It may be observed that the pressure creates a slight curve in the blade portion 54.

Figure 2:
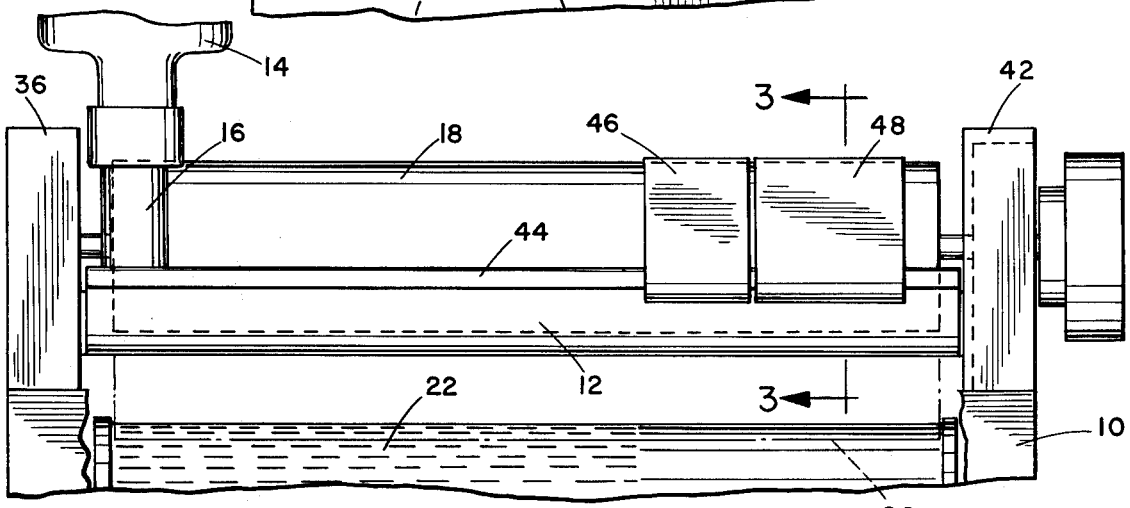
FIG. 2 is an enlarged end view of the water fountain section, as taken from the left hand side of FIG. 1.
Figure 3:
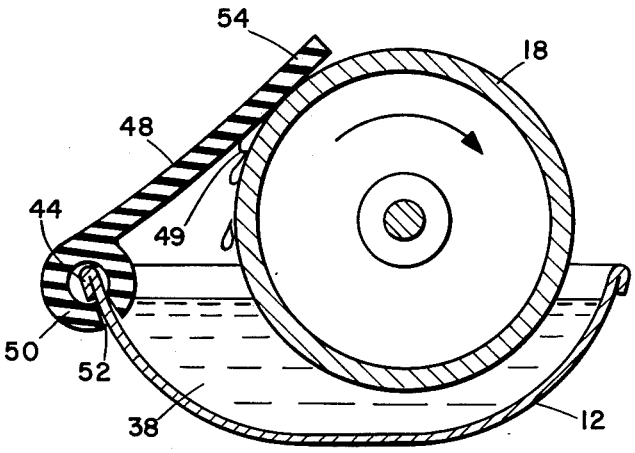
FIG. 3 is an enlarged sectional view taken on line 3—3 of FIG. 2, illustrating the fountain fluid wiping action.
Figure 4:
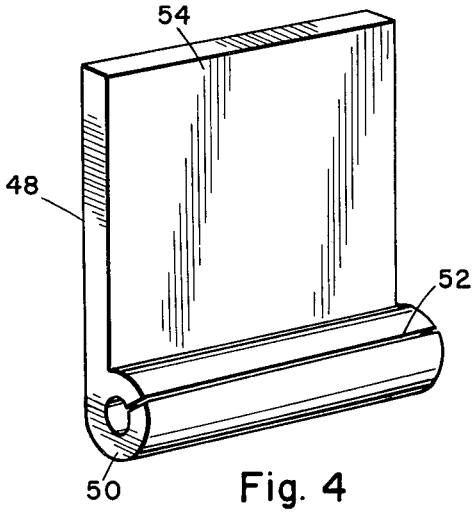
FIG. 4 is a perspective view of one fountain control wiper unit.

The roller 18 rolls in a direction away from the blade 54. The length of the wiper blade unit 48 is substantially less than the length of the roller 18, so a plurality of the wiper blade units can be mounted on the edge 44 of the fountain tray 12 and thus provide selective contact and water control on the fountain roller 18. As illustrated in FIG. 2, the wiper blade units 46 and 48 have different lengths and may be slidably moved along the edge 44 to provide water control on the roller at selective locations.

In operation, the fountain controlled wiper blade unit 48 is easily clipped on and removed from the water fountain tray. Each resilient wiper blade unit 48 has a predetermined positioned slit 52 that resiliently clamps over the edge 44 of the fountain tray. This causes the wiper blade to be resiliently biased against the surface of the water fountain roller 18.

In use, the water fountain control wiper blade unit can be selectively positioned anywhere along the length of the tray edge 44. Generally, the wipers are not placed closer than ½ inch from the outer edge of the water fountain roller as normally this outer area does not have sufficient water to need to have the water flow restricted. In running narrow paper stock or envelopes or the like, the wipers are placed in a position to restrict the flow of the fountain solution opposite or adjacent the area of the paper stock to be run through the press. This adjacent area to the paper stock will accumulate an excessive amount of fountain fluid in a very short length of running time, because there is no water absorption by the paper stock taking place in this area. This results in an immediate imbalance of ink in the fountain solution plus excessive moisture build up in this area. Also when the plate is running dry on the outer edges, an increase in water fountain solution can be made by increasing the speed of rotation of the water fountain roller. This increases the over-all water flow on other portions of the roller. But this excess water flow is then controlled by the wiper blade units 48. Thus by selectively positioning the wiper blade units 48 and by selectively adjusting the speed of rotation of the water fountain roller 18, combinations can be made for providing water flow control for the many different types of printing operations performed by the printer.

Having described my invention, I now claim:

1. A water fountain control wiper unit for mounting on the edge of a fountain tray in offset printing machines for controlling the amount of water on selective portions of the water fountain roller comprising:

a wiper blade and connector means unitarily constructed on a common resilient material, said wiper blade having a given length defined by that dimension extending parallel to the axis of a roller with which said blade cooperates and a width sufficient to extend from the edge of the water fountain tray to a point beyond the adjacent trangentially aligned surface of the water fountain roller, said wiper blade having a flat surface for engagement with the surface of a water fountain roller, said connector means includes a slit tubular portion extending at least partially along the length of said blade defining resilient gripper means for securing the wiper blade to the edge of the water fountain tray, said gripper means and said blade defining biasing means for resiliently biasing the flat surface of the wiper blade for resiliently contacting tangentially against the surface of the water fountain roller for removing water therefrom upon rotation of the water fountain roller.

2. A water fountain control wiper unit as claimed in claim 1 wherein, said wiper blade has a length substantially less than the length of the water fountain roller.

3. A water fountain control wiper unit as claimed in claim 2 wherein:

said connector means is formed along one edge of the blade portion.

4. A water fountain control wiper unit for mounting on the edge of a fountain tray in offset printing machines for controlling the amount of water on selective portions of the water fountain roller comprising:

a unitary wiper blade and connector means constructed of a common resilient material, said wiper blade having a given length defined by that dimension extending parallel to the axis of a roller with which said blade cooperates and a width sufficient to extend from the edge of the water fountain tray to a point beyond the adjacent tangentially aligned surface of the water fountain roller, said wiper blade having a flat surface for engagement with the surface of a water fountain roller, said connector means includes resilient gripper means for securing the wiper blade to the edge of the water fountain tray, said gripper means and said blade defining biasing means for resiliently biasing the flat surface of the wiper blade for resiliently contacting tangentially against the surface of the water fountain roller for removing water therefrom upon rotation of the water fountain roller, said connector means comprises a tubular portion extending along one edge of the blade along the entire length thereof, said tubular portion having a longitudinal slit along the length thereof for fitting over the edge of the water fountain tray and thereby defining said gripper means for resiliently holding the blade portion against the water fountain roller.

5. A water fountain control wiper unit as claimed in claim 4 wherein, said tubular portion is positioned to one side of said blade portion of the wiper blade.

6. A water fountain control wiper unit as claimed in claim 4 wherein, said surface of said wiper blade is smooth.

7. A water fountain control wiper unit as claimed in claim 4 wherein, said connector means exerts sufficient biasing force to resiliently bend the blade against the fountain roller to a curved shape under the resilient pressure.

* * * * *